US012109471B2

(12) United States Patent
Donnelly

(10) Patent No.: US 12,109,471 B2
(45) Date of Patent: Oct. 8, 2024

(54) CONVERTIBLE RECREATIONAL FLOATATION BOARD GAME DEVICE

(71) Applicant: SUNFUN1, LLC, Brielle, NJ (US)

(72) Inventor: Michael Donnelly, Fishkill, NY (US)

(73) Assignee: SunFun1, LLC, Brielle, NJ (US)

( * ) Notice: Subject to any disclaimer, the term of this patent is extended or adjusted under 35 U.S.C. 154(b) by 942 days.

(21) Appl. No.: 17/064,129

(22) Filed: Oct. 6, 2020

(65) Prior Publication Data

US 2022/0105402 A1 Apr. 7, 2022

(51) Int. Cl.
*A63B 67/06* (2006.01)
*B63B 32/50* (2020.01)

(52) U.S. Cl.
CPC ..... *A63B 67/06* (2013.01); *B63B 32/50* (2020.02); *A63B 2210/50* (2013.01); *A63B 2225/093* (2013.01)

(58) Field of Classification Search
CPC ..... A63B 67/06; A63B 2225/093; A63B 2225/60; A63B 2225/605; A63B 2210/50; A63B 2067/063; A63B 63/00; B63B 32/50; B63B 32/53; B63B 32/56
USPC ..... 273/348, 398–402
See application file for complete search history.

(56) References Cited

U.S. PATENT DOCUMENTS 4,276,844 A 7/1981 Fremont
4,712,394 A 12/1987 Bull
4,820,219 A 4/1989 Fortier, Jr. et al.
4,878,980 A 11/1989 Stedman
4,894,034 A 1/1990 Brown, III
4,961,715 A 10/1990 Shanelec
5,114,370 A 5/1992 Moran
5,116,269 A 5/1992 Moran
D327,721 S 7/1992 Plummer
5,137,483 A 8/1992 Nealy
5,154,655 A 10/1992 Glydon
5,211,593 A 5/1993 Schneider et al.
5,224,890 A 7/1993 Moran
5,238,434 A 8/1993 Moran
5,273,470 A 12/1993 Sneddon et al.
5,275,860 A 1/1994 D'Luzansky et al.
5,295,883 A 3/1994 Moran
5,304,082 A 4/1994 Wolfe
5,324,220 A 6/1994 Stewart
D349,322 S 8/1994 Wolfe
D349,551 S 8/1994 Wolfe
(Continued)

FOREIGN PATENT DOCUMENTS

AU 2019100952 A4 10/2019
GB 2522394 A 7/2015
(Continued)

*Primary Examiner* — Joseph B Baldori
(74) *Attorney, Agent, or Firm* — Lerner David LLP

(57) ABSTRACT

A recreational assembly includes a body, the body defining an aperture extending through the thickness of the body from the upper surface to the lower surface, and two lumens extending within the body. The assembly also includes two or more stringers removably insertable into the lumens, respectively, and a plug removably insertable into the aperture of the body. The plug includes upper and lower plates configured to be secured within the aperture. Each of the upper and lower plates includes an anchor on one side configured to connect with an end of one of the stringers.

21 Claims, 12 Drawing Sheets

(56) References Cited

U.S. PATENT DOCUMENTS

D349,744 S 8/1994 Wolfe
D351,009 S 9/1994 Wolfe
5,358,438 A 10/1994 Wolfe
5,385,521 A * 1/1995 Weissbuch ..... A63B 69/14 434/254
D356,618 S 3/1995 Fleming
5,394,822 A 3/1995 Worland
5,401,117 A 3/1995 Lochtefeld
5,503,921 A 4/1996 Chang et al.
5,516,320 A 5/1996 LaPlant
5,533,918 A 7/1996 Sanders
5,603,645 A 2/1997 Saccomanno
5,618,215 A 4/1997 Glydon
5,628,584 A 5/1997 Lochtefeld
5,634,834 A 6/1997 Cole et al.
5,637,172 A 6/1997 Kerr
5,647,784 A 7/1997 Moran
D389,546 S 1/1998 Stewart
5,738,556 A 4/1998 Palmieri
5,797,779 A 8/1998 Stewart
5,899,633 A 5/1999 Lochtefeld
5,934,961 A 8/1999 Mehrmann et al.
5,938,879 A 8/1999 Brown
5,957,741 A 9/1999 Evans
6,000,979 A 12/1999 Stewart
6,012,734 A 1/2000 Skedeleski
6,036,560 A 3/2000 Pekar
6,038,722 A 3/2000 Giori et al.
6,106,345 A 8/2000 Yeh
6,132,317 A 10/2000 Lochtefeld
6,135,837 A 10/2000 Giles
6,183,333 B1 2/2001 Hall
6,203,389 B1 3/2001 Pearson
6,257,944 B1 7/2001 Herrod
D446,273 S 8/2001 Natale
6,319,137 B1 11/2001 Lochtefeld
6,394,865 B1 5/2002 Arzadon
D462,406 S 9/2002 Kessler
6,461,210 B2 10/2002 Lorenzo
6,462,101 B1 10/2002 Ramesh et al.
6,491,589 B1 12/2002 Lochtefeld
6,492,013 B1 12/2002 Ramesh
6,688,931 B2 2/2004 Hart
6,712,657 B1 3/2004 Echecopar
6,716,107 B2 4/2004 Lochtefeld
6,764,756 B1 7/2004 Ramesh
6,773,798 B2 8/2004 Ramesh
6,790,112 B2 9/2004 Kirk
6,908,351 B2 6/2005 Burke
6,955,576 B2 10/2005 Yeh
6,988,920 B2 1/2006 Yeh
7,144,285 B1 12/2006 Hendricks
7,156,594 B1 1/2007 Witt et al.
7,172,481 B2 2/2007 Yeh
7,246,568 B1 7/2007 Cheung
7,326,094 B2 2/2008 Yeh
7,344,425 B2 3/2008 Yeh
7,347,754 B1 3/2008 Cheung
7,368,031 B2 5/2008 Lehr et al.
7,401,786 B2 7/2008 Lochtefeld
7,404,749 B2 7/2008 Cheung
7,410,399 B2 8/2008 Blumenfeld
7,425,190 B2 9/2008 Kolarick et al.
7,481,690 B2 1/2009 Shibata
7,491,105 B2 2/2009 Yeh
7,513,504 B2 4/2009 Lochtefeld
D598,514 S 8/2009 Walworth
7,575,493 B2 8/2009 Cheung
7,578,254 B2 8/2009 Cheung
7,628,664 B2 12/2009 Yeh
7,654,877 B2 2/2010 Yeh
7,658,571 B2 2/2010 McFarland
7,666,104 B2 2/2010 Lochtefeld
7,670,202 B2 3/2010 Yeh
7,722,291 B2 5/2010 McFarland
7,798,877 B1 9/2010 Wortham
7,819,713 B2 10/2010 Yeh
7,896,778 B1 3/2011 Phillips
7,896,779 B1 3/2011 Phillips
7,922,550 B2 4/2011 Yeh
7,927,163 B2 4/2011 Zeyger
7,930,985 B2 4/2011 Walworth et al.
7,938,705 B2 5/2011 Fitzgerald
8,096,845 B2 1/2012 Yeh
D658,257 S 4/2012 Whitehead
8,246,405 B2 * 8/2012 Checkley ..... B63B 32/00 441/65
8,298,027 B1 10/2012 Basse
8,303,213 B2 11/2012 McFarland
8,323,064 B2 12/2012 Lessing
8,357,236 B1 1/2013 Virgillitti
8,425,337 B2 4/2013 Thompson
8,465,334 B2 6/2013 Hort et al.
8,523,484 B2 9/2013 McFarland
8,530,036 B2 9/2013 Thompson
8,602,685 B1 12/2013 McFarland
8,662,947 B2 3/2014 Mann
D703,285 S 4/2014 Chiu
8,702,462 B1 4/2014 Klokow et al.
8,764,017 B2 * 7/2014 Manner ..... A63F 9/001 273/400
8,888,546 B2 11/2014 Dykstra et al.
9,056,149 B2 6/2015 Bianchi
9,067,654 B2 6/2015 Lessing
9,068,371 B2 6/2015 McFarland
9,073,611 B2 7/2015 Berenson
9,248,888 B2 2/2016 Chiu
9,358,439 B2 * 6/2016 Manner ..... A63B 63/083
9,394,036 B2 7/2016 Krietzman
D767,217 S 9/2016 Hickling
D767,218 S 9/2016 Hickling
9,486,083 B2 11/2016 Berenson et al.
9,572,378 B2 2/2017 Canales et al.
9,592,433 B2 3/2017 Alleshouse et al.
9,661,881 B2 5/2017 Canales et al.
9,688,365 B2 6/2017 Norrie et al.
9,775,328 B1 10/2017 Fidrych
D806,171 S * 12/2017 Nally ..... A63B 67/06 D21/303
9,854,854 B2 1/2018 Canales et al.
9,878,765 B2 1/2018 McCracken et al.
9,914,511 B2 3/2018 Chiu
9,926,051 B2 3/2018 Miller
9,957,019 B2 5/2018 Sciarra
9,975,612 B1 5/2018 Ellis
10,010,184 B2 7/2018 Berenson et al.
10,060,591 B2 8/2018 Voaklander
10,081,415 B1 9/2018 Sun
10,085,494 B2 10/2018 Canales et al.
10,086,918 B2 10/2018 Pepper et al.
10,098,389 B2 10/2018 Canales et al.
10,118,677 B2 11/2018 Zapata
10,300,360 B2 5/2019 Hequily
10,358,192 B2 7/2019 Sitar
10,426,247 B2 10/2019 Mitzev
10,427,764 B2 10/2019 Tang
10,435,120 B2 10/2019 O'Rourke
10,457,355 B2 10/2019 Schenck et al.
10,583,901 B2 3/2020 Warll
10,611,443 B2 4/2020 MacDonald
10,629,103 B2 4/2020 Forgey
RE48,000 E 5/2020 McFarland
10,654,547 B2 5/2020 Miller
10,661,864 B2 5/2020 Warll
10,918,923 B1 * 2/2021 Musser ..... A63B 63/007
11,351,431 B2 * 6/2022 Falck ..... A63B 67/007
D967,317 S * 10/2022 Daszkowski ..... D21/301
2005/0136706 A1 * 6/2005 Yeh ..... B63B 32/22 439/74
2006/0247072 A1 * 11/2006 Combs ..... A63B 63/00 473/348
2010/0311294 A1 * 12/2010 Foulke ..... B63B 32/66 441/79

(56) References Cited

U.S. PATENT DOCUMENTS

| | | | | |
|---|---|---|---|---|
| 2011/0095484 | A1* | 4/2011 | Scott | A63B 67/06 273/336 |
| 2012/0052755 | A1 | 3/2012 | Durante | |
| 2014/0091526 | A1* | 4/2014 | Nally | A63B 63/08 273/402 |
| 2014/0141667 | A1 | 5/2014 | DiLorenzo et al. | |
| 2017/0001694 | A1 | 1/2017 | Hayward et al. | |
| 2019/0168849 | A1 | 6/2019 | Sebastjan | |
| 2020/0039614 | A1 | 2/2020 | Pacini | |
| 2021/0260456 | A1* | 8/2021 | Lombardini | A63B 71/023 |
| 2023/0134331 | A1* | 5/2023 | Babineau | A63B 67/06 273/350 |
| 2024/0115917 | A1* | 4/2024 | Liang | A63B 67/007 |

FOREIGN PATENT DOCUMENTS

| | | | |
|---|---|---|---|
| JP | 5583013 | B2 | 9/2014 |
| WO | 2005085058 | A1 | 9/2005 |
| WO | 2013175039 | A1 | 11/2013 |

* cited by examiner

CONVERTIBLE RECREATIONAL FLOATATION BOARD GAME DEVICE

BACKGROUND OF THE INVENTION

A popular game of bean bag toss, also known as cornhole, is played worldwide and particularly in outdoor spaces. The game includes several bean bags and a large propped-up board with a hole at which the bean bags are aimed. Because the beanbags are thrown from several yards away, the board is typically constructed from sturdy material, such as wood, that can withstand the repeated forces on the surface of the board. However, the regulation-sized board and any attached legs or props tend to be bulky and heavy, making the game somewhat difficult and cumbersome to transport. This can be magnified when the bean bag toss game is included among other games, equipment, or gear in an excursion, such as a beach or camping trip.

Accordingly, there is a desire in the market to make a bean bag toss or target game easier and more efficient to transport so that it can be more frequently included in gatherings, all without compromising the typical configuration and experience of traditional game play.

BRIEF SUMMARY OF THE INVENTION

A convertible water sport board apparatus is provided herein that allows for the board to be used in the water as a traditional kickboard, bodyboard, surfboard, stand-up paddleboard, and on land as a bean bag toss or ball toss target board game. One novel feature of the apparatus is the strategically located circular aperture that is plugged with dual circular plates, one of which is placed on the top surface of the board, and the other on the bottom surface of the board. These plates have cylindrical rings that are inserted into either end of the aperture and a cap on the external end of the plate which has a slightly larger dimension than the cylinder. This larger surface area creates a top lip that settles into a circular recessed area molded into the board allowing the caps to stay flush to the top and bottom of the board.

According to an aspect of the disclosure, a floatation device may include a board or body with an aperture extending therethrough. The board may define a symmetrical and generally planar shape. The shape may be substantially defined by a unitary piece of substrate, which may be ethylene-vinyl acetate or a functionally similar material. The aperture may be located at a position on the board that is centered laterally and is longitudinally near a front end of the board.

An assembly including the floatation device may also include two half plugs removably securable in the aperture. The two half plugs may be disks, or generally disk-like in shape. The half plugs may be externally threaded for engaging internal threading of the aperture, or threaded for connection to one another. The assembly may further include two stringers removably insertable through the board. The half plugs may each include an anchor able to hold an end of either of the stringers. The board may further include two holes near its front end each able to receive an end of either of the stringers. The assembly may further include two stops each removably securable in one of the holes. One or both of the half plugs may include two openings into which the stops are removably securable. The assembly may further include a fin removably securable to one of the half plugs.

In another aspect, a recreational assembly may comprise a body having an upper surface, a lower surface, and a thickness defined between the upper and lower surfaces, the upper surface having a width and a length, wherein the thickness is less than the width, the body defining an aperture extending through the thickness of the body from the upper surface to the lower surface, and two lumens extending within the body. The assembly may also comprise two or more stringers removably insertable into the lumens, respectively, and a plug removably insertable into the aperture of the body, the plug including upper and lower plates configured to be secured within the aperture, wherein each of the upper and lower plates includes an anchor on one side configured to connect with an end of one of the stringers.

In some arrangements, the body may be constructed of a closed cell copolymer.

In some arrangements, the plug may be inserted into the aperture of the body, the plug substantially fills the aperture.

In some arrangements, the body may define two body holes extending through the thickness of the body.

In some arrangements, one of the upper and lower plates may define two plate holes extending therethrough.

In some arrangements, the assembly may comprise two stops insertable into the respective body holes and the respective plate holes.

In some arrangements, the stops may be externally threaded.

In some arrangements, the assembly may comprise a tether attachable to one of the stops.

In some arrangements, the assembly may comprise a fin attachable to one of the plates.

In some arrangements, each of the plates may include an externally threaded ring and a cap at an end of the ring, the cap having a greater area than a circular cross-section of the ring.

In some arrangements, the plug may be inserted into the aperture of the body, the cap of each of the plates is substantially flush with one of the upper and lower surfaces of the body.

In some arrangements, the anchor may be a socket is disposed on a side of the cap facing into the ring.

In some arrangements, the lumens may extend along the length of the body.

In some arrangements, the upper surface of the body may be substantially flat.

In some arrangements, the width of the upper surface may be no greater than 24 inches, the length of the upper surface is no greater than 48 inches, and the aperture is circular with a diameter of 6 inches.

In another aspect, a recreational kit may comprise the recreational assembly and a bean bag or a ball sized to pass through the aperture.

In some arrangements, when the assembly is in a water sports configuration, each of the two stringers may be disposed within a respective one of the lumens, and the plug may be disposed in the aperture.

In some arrangements, when the assembly is in a game configuration, each of the two stringers may have a first end disposed in one of the two body holes and a second end connected with the anchor of one of the upper and lower plates, with the upper and lower plates and an end of the body configured to be disposed on an external surface.

In some arrangements, the external surface may be the ground.

In some arrangements, the external surface may be a surface of a body of water.

In another aspect, a method of using a recreational kit may comprise releasing two half plugs from opposite sides of an aperture through a board, placing both half plugs on a surface after the half plugs have been released from the aperture, removing two stringers from lumens in the board, contacting an end of each stringer to an anchor of a respective one of the disks after the disks have been placed on the surface, and propping the board such that it is supported on both stringers and the surface after the ends of the stringers have been contacted to the anchors.

In some arrangements, the method may comprise unthreading stops from the half plugs before placing the half plugs on the surface.

In some arrangements, the method may comprise threading the stops into holes through the board after the stops have been unthreaded from the half plugs.

In some arrangements, propping the body may include inserting an end of each of the stringers in a recess at and end of one of the stops.

In some arrangements, the method may comprise filling ring portions of the half plugs with ballast after the half plugs have been released from the aperture.

In some arrangements, the method may comprise detaching a fin from one of the half plugs before placing the half plugs on the surface.

In some arrangements, the method may comprise tossing a bean bag at the board after it has been propped.

In another aspect, a recreational assembly may comprise a body formed of a closed cell copolymer and having an upper surface, a lower surface, and a thickness defined between the upper and lower surfaces, the upper surface having a width and a length greater than the width, wherein the thickness is less than the width, the body defining an aperture extending through the thickness of the body from the upper surface to the lower surface, two lumens extending within the body along a length of the body, and two holes extending through the thickness of the body. The assembly may further comprise two or more stringers removably insertable into the lumens, respectively, two stops removably securable through the two holes in the body; and a plug removably insertable into the aperture of the body, the plug including upper and lower plates configured to be secured within the aperture, wherein each of the upper and lower plates includes an anchor on one side configured to connect with an end of one of the stringers.

DETAILED DESCRIPTION

As used herein, relative terms such as "about," "approximately," or "substantially" refer to a range of contemplated values including the recited value itself and other values within ±15% of the recited value.

Figure 1A:
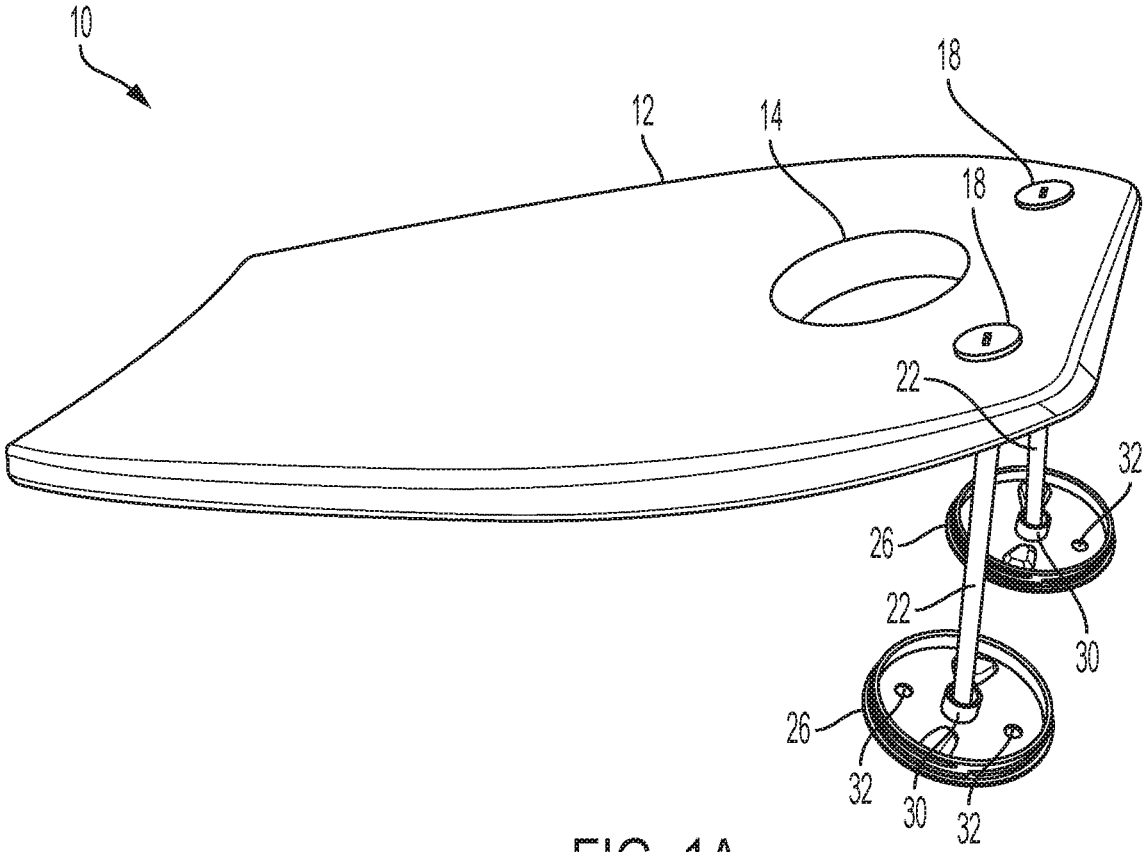
FIG. 1A is an oblique perspective view of a recreational assembly in a lawn game configuration.

A recreational assembly 10 in accordance with the present invention is illustrated in FIG. 1A. The assembly 10 is configured for use as a both bodyboard in water and as a bean bag toss game on land, all while using a set of components that allow for easy conversion between the two configurations. FIG. 1A shows the assembly 10 in a yard game configuration.

The assembly 10 generally includes a body or board 12, two or more stringers 22, and a plug made up of two half plugs 26 that fill an aperture 14 extending through the board 12. The stringers 22 are stiffer than the board 12, meaning their insertion into the board 12 makes the board 12 more rigid and resistant to bending. Two stops 18 are inserted into the board 12 through smaller apertures. An end of each of the two stops 18 protrudes from an underside of the board 12 and is abutted by one of the stringers 22 in the yard game configuration so that the board 12 can be propped up at one end. The board 12 is propped up at a forward end on the stringers 22, and rests at a distal end on a supporting surface. Each of the two stringers 22 is supported on one of the half plugs 26 resting on the supporting surface. The two half plugs 26 are identical "plates," e.g. a deck plate that used with the top of the board 12 and a skin plate used with the bottom of the board 12. The half plugs 26 each include an anchor 30 in the form of a socket that receives an end of one of the stringers 22. In other embodiments, anchor 30 can be a protrusion that fits within a cavity or lumen of the stringer 22. The half plugs 26 help to anchor the ends of the stringers 22 on the supporting surface. In the yard game configuration of assembly 10, the half plugs 26 may be filled and/or surrounded with a ballast such as sand, rubble, bricks, or any other suitable heavy substance or object that is readily available to further anchor the ends of the stringers 22 and to maintain the propped up configuration of the board 12.

The stringers 22 are tubular or solid components inserted or embedded within the board 12 to deliver stability and/or flexibility. They are made of a variety of lightweight and rigid materials including but not limited to fiberglass, plastic resins, carbon fiber, wood, aluminum, or polymers such as polyvinyl chloride. The stringers 22 are removable to serve as braces and support the board 12 with one end raised for on-land play. The stringers 22 may have threaded ends to connect to the socket of half plugs 26 on one end and the threaded leash plug and bushing (or stops 18) on the other end. The angle of the stringers will depend upon the length of the board and how high the end with the aperture 14 is raised. The stringers 22 can be adjustable, such as having a telescoping configuration.

The board 12 may be made of a substrate of a suitable buoyant material, such as ethylene-vinyl acetate (EVA) or another closed cell copolymer, that is cut, molded, or otherwise formed to a desired shape. The board 12 is a flotation device, which is capable of floating in water. The board 12 can be an aquatic sports board such as a surfboard used traditionally or in windy environments with a sail, a paddleboard, a wakeboard, a kneeboard, a bodyboard, a kiteboard, or other similar types of sports boards. Any moderately resilient material providing enough buoyancy after forming to the shape of the board 12 to allow the board 12 to function as a bodyboard may be used, meaning a wide variety of materials, particularly polymers and copolymers, are suitable materials for the substrate. EVA is particularly suitable due to its resilient, buoyant, closed cell structure that can withstand the usual stresses involved with some watersports, while preventing the board 12 from becoming waterlogged when a part is cut or broken away. Moreover, EVA has a high tolerance for exposure to ultraviolet light. In EVA, the weight percent of vinyl acetate usually varies from 10 to 40%, with the remainder being ethylene. The closed cell properties of EVA, and other copolymers, makes such materials well suited for use in outdoor water sport products due to their durability, waterproof properties and high UV tolerance to effects such as delamination and blistering, handicaps that are common with traditional surf and bodyboard materials. In addition, the ratio of the ethylene and vinyl acetate monomers can be adjusted during the manufacturing process to deliver different characteristics in the final product, including buoyancy, softness, flexibility, rigidity, and surface gloss. Closed cell copolymers like EVA can be molded using thermal and compression techniques for one-piece custom designs and shapes that deliver exceptional durability. Styrofoam, polyethylene polypropylene and other less expensive materials may be used for lower cost variations.

Known bodyboards and surfboards are manufactured using a core, a deck for the top of the board, a slick for the bottom of the board, and rails providing a perimeter for the board. The core is usually an open cell polymer such as polyethylene, polypropylene, or extruded polystyrene as these materials are buoyant, durable, affordable, and easy to work with. However, open cell polymers are susceptible to absorbing liquid and becoming waterlogged, so the deck, slick, and rails are typically made from materials impermeable by water, such as high density polyethylene or a copolymer of ethylene and methacrylic acid marketed by DuPont under the trade name Surlyn. Boards so constructed are lightweight, sturdy, and buoyant, but may become waterlogged if any of the impermeable portions are damaged. However, some of the materials used for known decks, slicks, and rails react poorly to prolonged exposure to ultraviolet light and may blister and delaminate from the core. Further, complex board shapes can be difficult to seal effectively. Thus, use of a closed cell polymer as a board 12 material can make provision of an aperture 14 and holes for the stringers 22 simpler, and can make the finished board 12 more resistant to waterlogging in general.

The material contributes to the upper surface of the board 12 being substantially flat when in the yard game configuration. In fact, additional stringers 22 may be provided so that some or all of the lumens of the board 12 include stringers 22 in the yard game configuration to bolster the strength of the board 12 during such game play, e.g. to more easily absorb the impact of bean bags or other objects without significantly bending or yielding. This allows the flexibility of the board 12 to be determined by the user in the yard game configuration. Certain embodiments of the board 12 can be made entirely of a closed cell polymer such as EVA, and other may be made of a foam material enclosed within a hard shell such as fiberglass, plastic, epoxy, carbon fiber, or similar material.

Figure 1B:
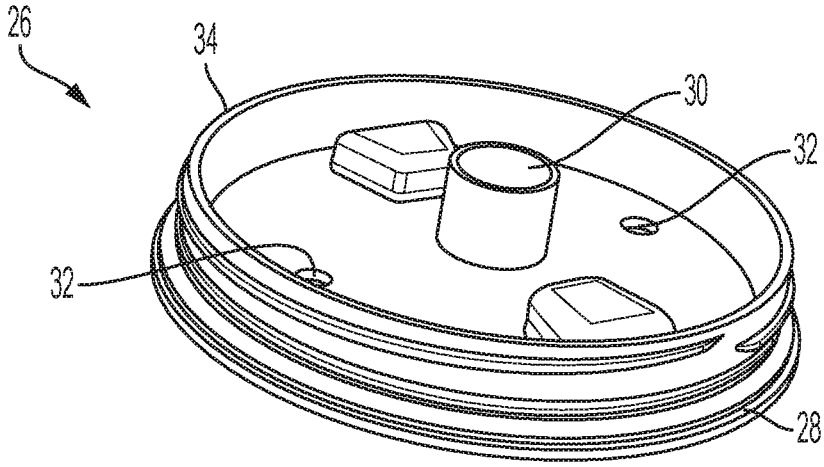
FIGS. 1B-1E illustrate various arrangements of a half plug of the assembly of FIG. 1A.

In the illustrated arrangement, the aperture 14 of board 12 is internally threaded and circular, and the half plugs 26 each have a complementary externally threaded disc shape. The half plugs 26 of the illustrated arrangement each include a plate 28 and an externally threaded ring 34 on one side of the plate 28, as shown in FIG. 1B. The anchors 30 each extend from a side of their respective plate 28 into a central portion defined by the respective ring 34. The half plugs 26 are therefore removably securable in the aperture 14 by threading into the aperture 14 from either side to cooperatively form one plug filling the aperture 14. In this manner, the half plugs 26 can be inserted into board 12 to be substantially flush with the upper and lower surfaces of the board 12 so that the board 12 and the half plugs 26 together provide uninterrupted upper and lower surfaces of the assembly 10 so that it can function as a bodyboard. That is, the plug comprised of both half plugs 26 substantially seals and fills the aperture 14 within the board 12. The threading of half plugs 26 is deep enough so that half plugs 26 can securely grip the material of board 12 so that they do not dislodge during normal use of assembly 10 in the water. Moreover, the EVA material in particular provides a relatively simple construction for the board 12 and is able to avoid bloating and becoming waterlogged at the interface of the board 12 with half plugs 26. In other arrangements, the half plugs 26 are directly securable to one another, for example by one half plug having an internally threaded ring and the other having a complementary externally threaded ring, to form a single plug through the aperture 14 from opposite sides, such as by opposed complementary threading arrangements. In another embodiment, a threaded collar can be provided within the aperture 14 into which half plugs 26 can be threaded. In all cases, the half plugs 26 would be flush to the surfaces of the board 12 and the material of the board 12 will be compressed to help secure the half plugs 26. In various arrangements, either or both of the plates 28 of the half plugs 26 may be textured or smooth on a side opposite from the ring 34, according to whether the half plug 26 will be used on the upper surface of the bodyboard and can enhance the grip of the user when textured or will be used on the lower surface of the bodyboard and can enhance the frictionless nature of the bodyboard when smooth.

The anchors 30 may or may not be internally threaded to threadingly hold the stringers 22 or otherwise be provided with internal features for releasably retaining the stringers 22. In the example of a half plug 126 illustrated in FIG. 1C, anchors 130 include a pivot bar 131 extending across a cavity of the anchor 130. An end of a stringer 22 can be split so that it can rock in two directions within the anchor 130 on the pivot bar 131, so the pivot bar 131 can be advantageous in propping the board 12 on an uneven supporting surface. The stringers 22 may each have a notch on either end to slide over the pivot bar 131. In a further alternative shown in FIG. 1D, a half plug 226 can include an angled anchor 230 configured to hold a stringer 22 at an intended angle for propping up the board 12.

Figure 1C:
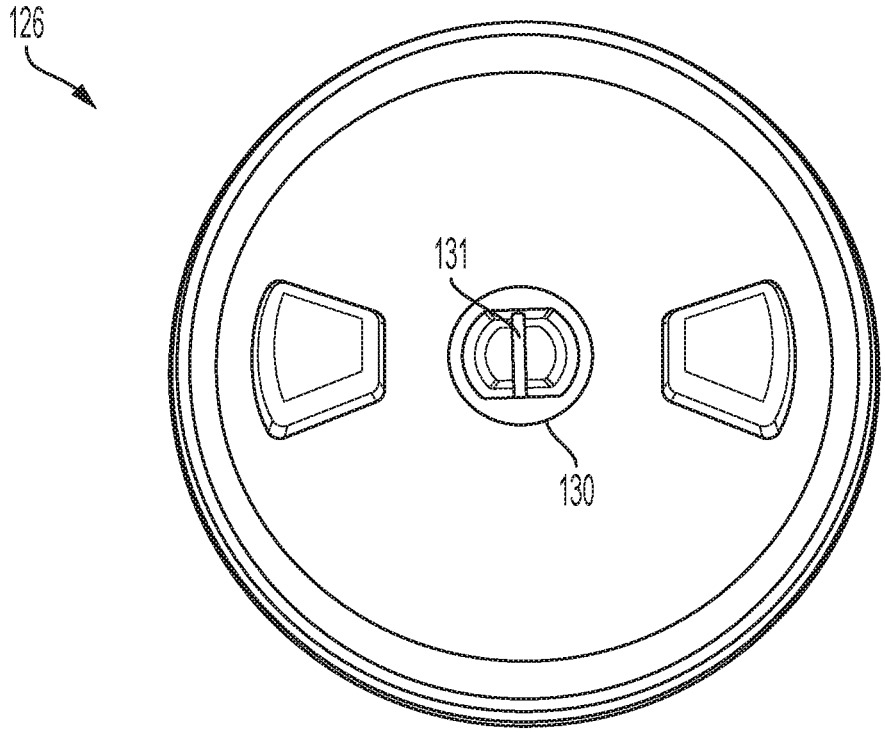
Figure 1D:
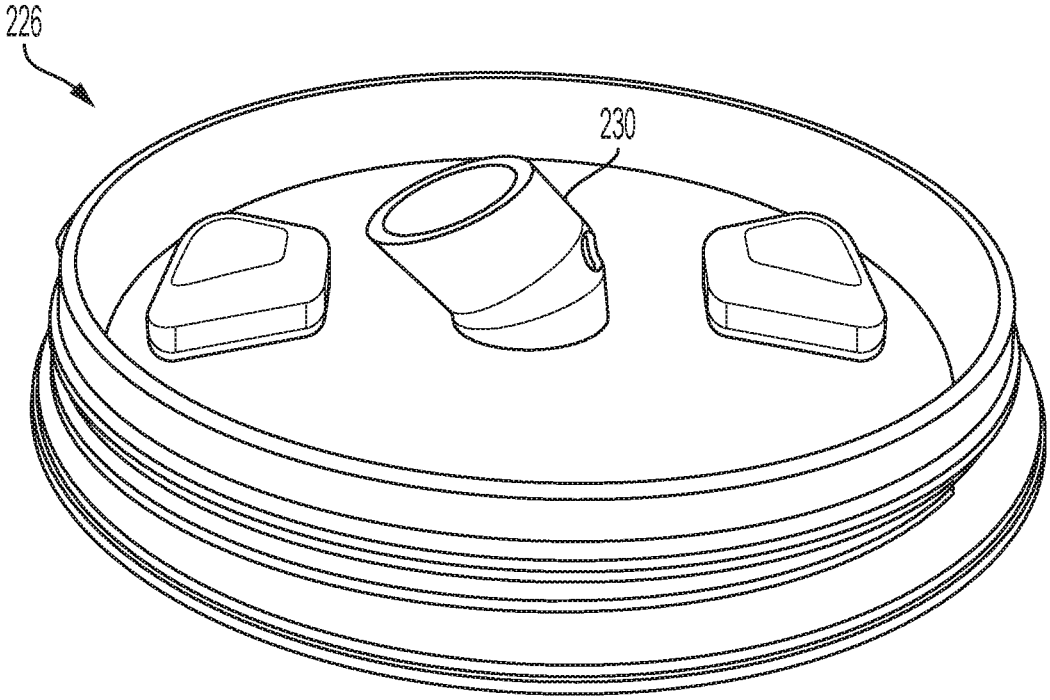
Figure 1E:
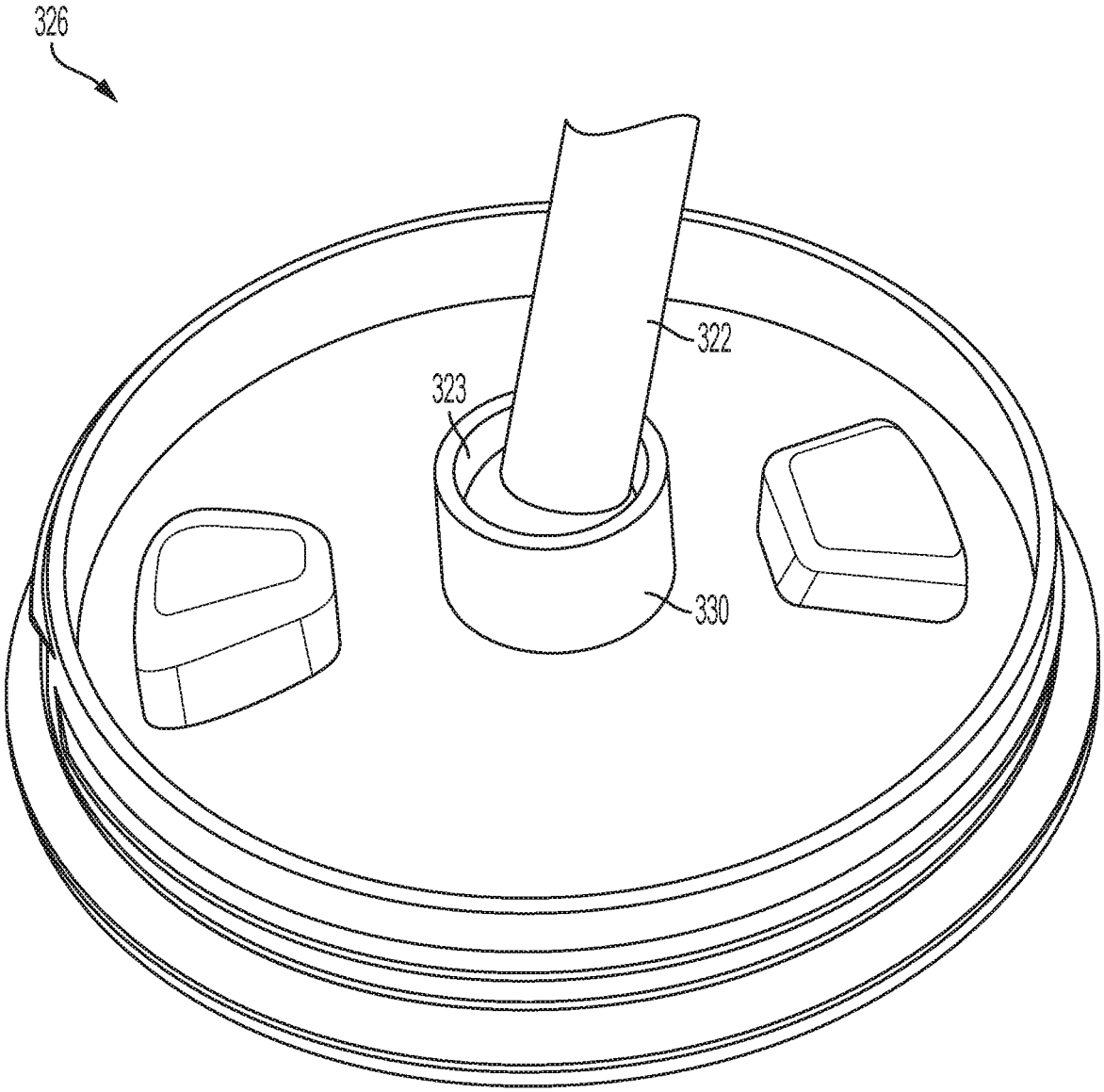

In another arrangement shown in FIG. 1E, an anchor 330 of a half plug 326 can include a partially spherical socket for receiving a ball 323 at an end of a stringer 322. The ball 323 is sized relative to the socket of the anchor 330 such that the ball 323 can tightly fit within the anchor 330 while allowing pivoting movement but preventing separation therebetween. The ball 323 can pivot within the anchor 330, enabling the half plug 326 to tilt relative to the stringer 322 when the assembly 10 if the assembly 10 is in the lawn game configuration.

The features of the half plugs 126, 226, 326 of FIGS. 1C, 1D, and 1E are generally similar to the half plug 26 of FIG. 1B, except for the lack of apertures 32 (discussed below) and differences described above, and are therefore not numbered or further described here.

Returning to FIG. 1A, the stops 18 are designed to be releasably securable through holes in the board 12. The stops 18 may be leash plugs, including an externally threaded bolt and two caps, with at least one of the caps being internally threaded and therefore selectively releasable from the bolt or tightenable against the board 12. However, in other arrangements, the stops 18 include bolts 19 that are significantly longer than a thickness of the board 12, as shown in FIG. 2A-2D. In some embodiments, the stops 18 can accommodate or anchor external devices such as a waterproof camera during use in either the water or land configuration of assembly 12.

Figure 2A:
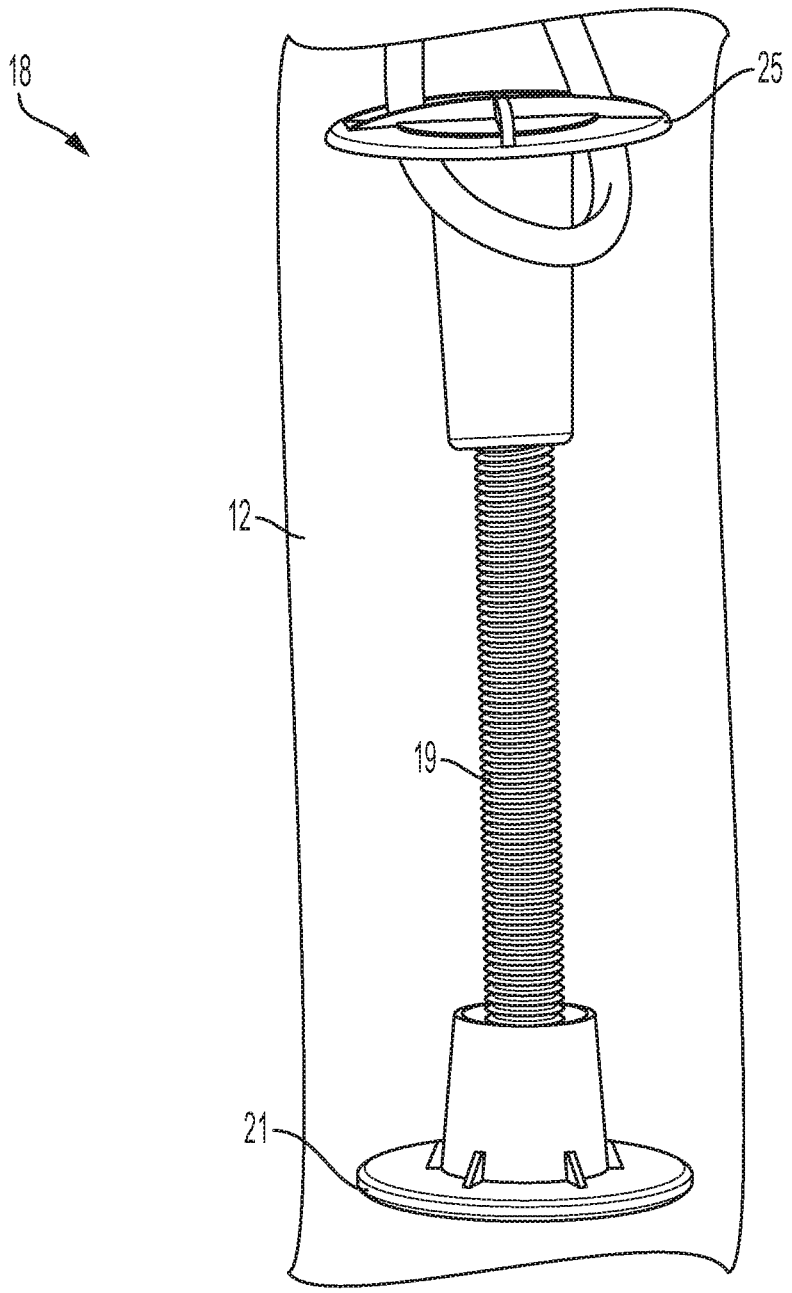
FIG. 2A illustrates a stop according to an arrangement.

In an arrangement of a stop 18 of FIG. 2A, the caps of the stop 18 are a flanged open bushing 21 and a flanged closed bushing 25, both bushings 21, 25 being internally threaded. In the arrangement illustrated in FIGS. 2A-2D, the bolts 19 are longer than a thickness of the board, and each of the stops 18 includes an open bushing 21, such that the bolt 19 may extend beyond the open bushing 21 to support a hollow stringer 22. In other arrangements, the bolts 19 may only be as long as the thickness of the board 12, both bushings associated with each stop 18 may be closed bushings 25, and the stringers 22 may not be hollow.

Figure 2B:
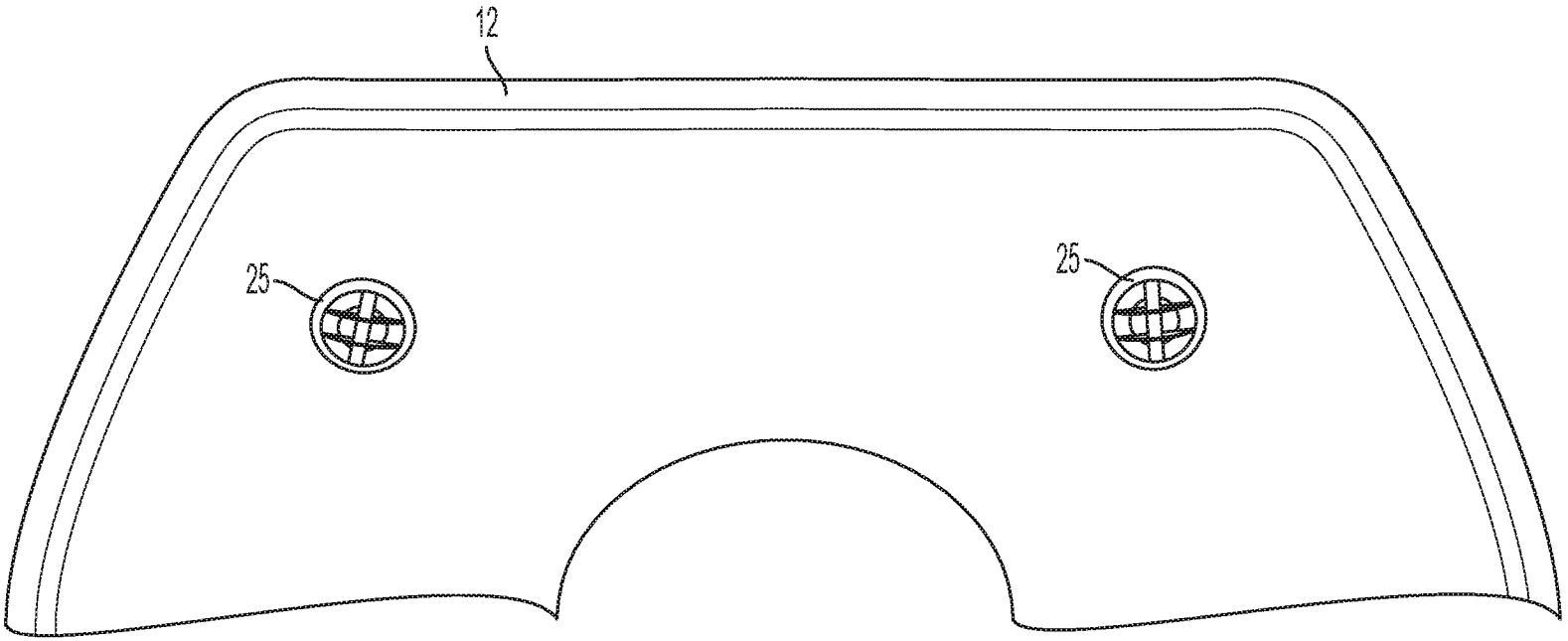
FIG. 2B is an upperside view of the assembly of FIG. 1A in a partially disassembled state.
Figure 2C:
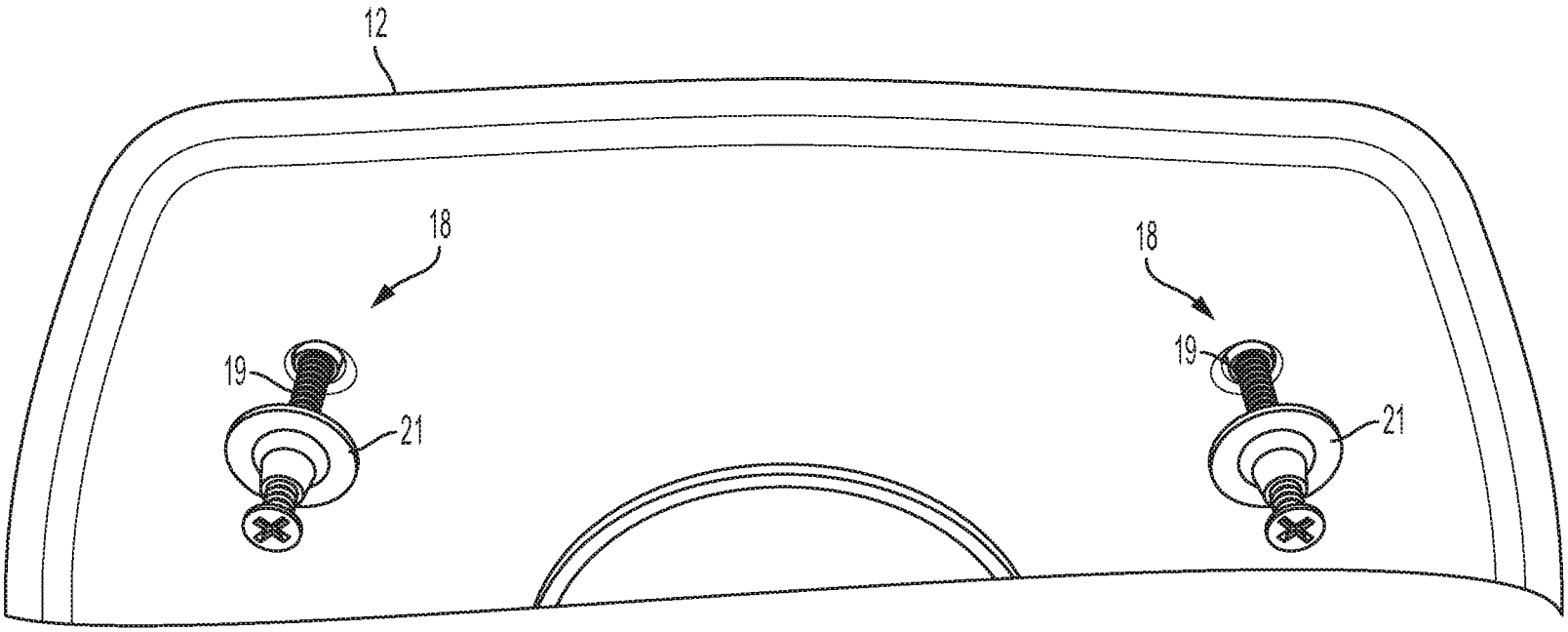
FIGS. 2C and 2D are underside views of the assembly of FIG. 1A in partially disassembled states.
Figure 2D:
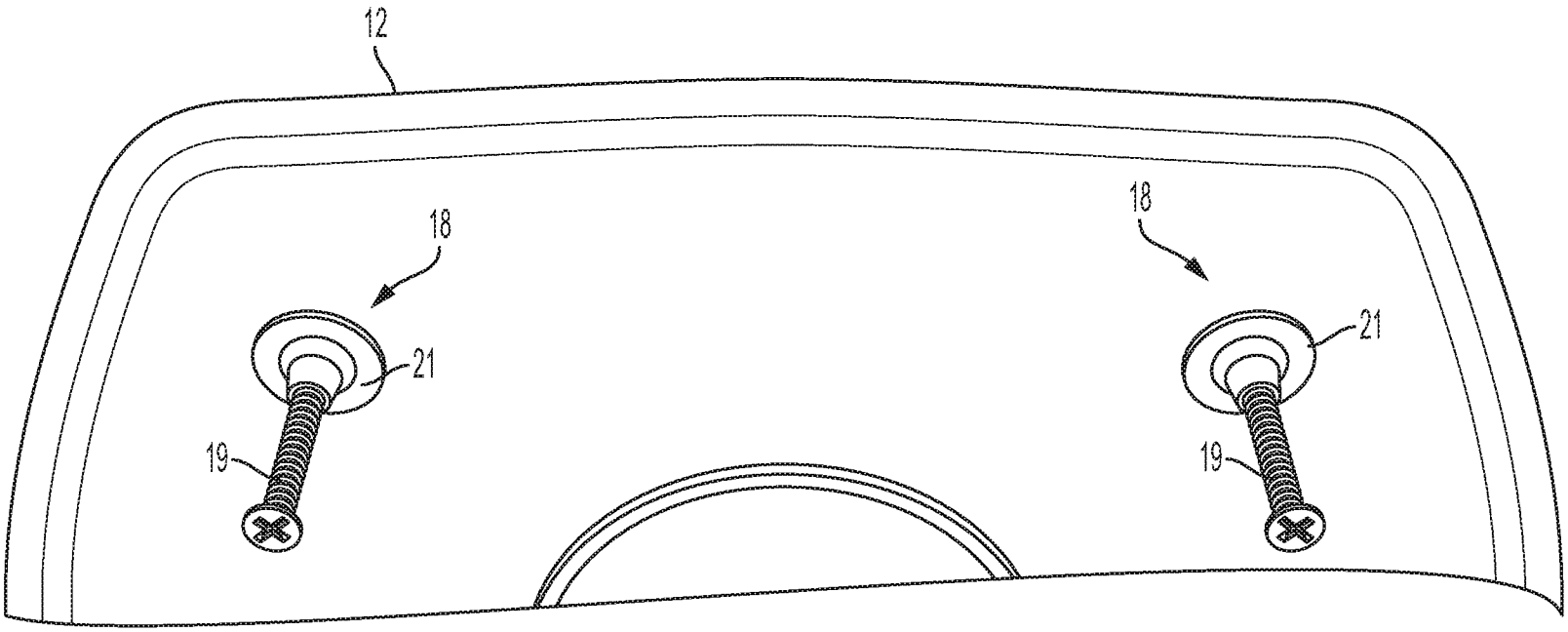

At least the closed bushings 25 are dimensioned to fit within the holes through the board 12 that accept the bolts 19, except for the flanges of the bushings 21, 25, which sit flat against opposite sides of the board 12. Thus, as shown in FIG. 2B, the closed bushings 25 can be pressed into holes in the board 12 from an upper side of the board such that portions of the closed bushings 25 other than the flange extend into the holes. Next, as shown in FIG. 2C, the bolts 19, with the open bushings 21 already threaded on, can be inserted into the holes through the board 12 from an underside of the board and threaded into the portions of the closed bushings 25 extending into the holes. Finally, as shown in FIG. 2D, the open bushings 21 can be turned about the bolt 19 to extend partially into the holes through the board 12 and until the flanges of the open bushing 21 and closed bushing 25 on each bolt 19 cooperate to tighten against the board 12. With the bolts 19 protruding from the underside of the board 12, a hollow stringer may be placed on each bolt 19 to support the assembly 10 in the lawn game configuration shown in FIG. 1A.

In alternative arrangements, the bolt 19 may have a large enough head to replace the closed bushing 25. In other alternative arrangements, the bolt 19 may lack a head altogether. In arrangements wherein the bolt's 19 head replaces the closed bushing 25 or the bolt 19 lacks a head altogether, the bolt 19 may be passed through the holes in the board 12 from the top side of the board 12, and the open bushings 21 may be threaded onto the bolts 19 from the underside of the board 12 thereafter.

The stringers 22, if hollow, can slide over the bolt and abut the nut 21 to anchor securely to and support the board 12. Sliding over the bolts maintains the stringers 22 in an intended location and/or alignment relative to the board 12, and abutting the bushings or nuts distributes force from the stringers 22 on the board 12. The stringers 22 can therefore prop the board 12 without impacts to the board 12, such as bean bags landing on the board 12, causing the stringers 22 to puncture the board.

Figure 3:
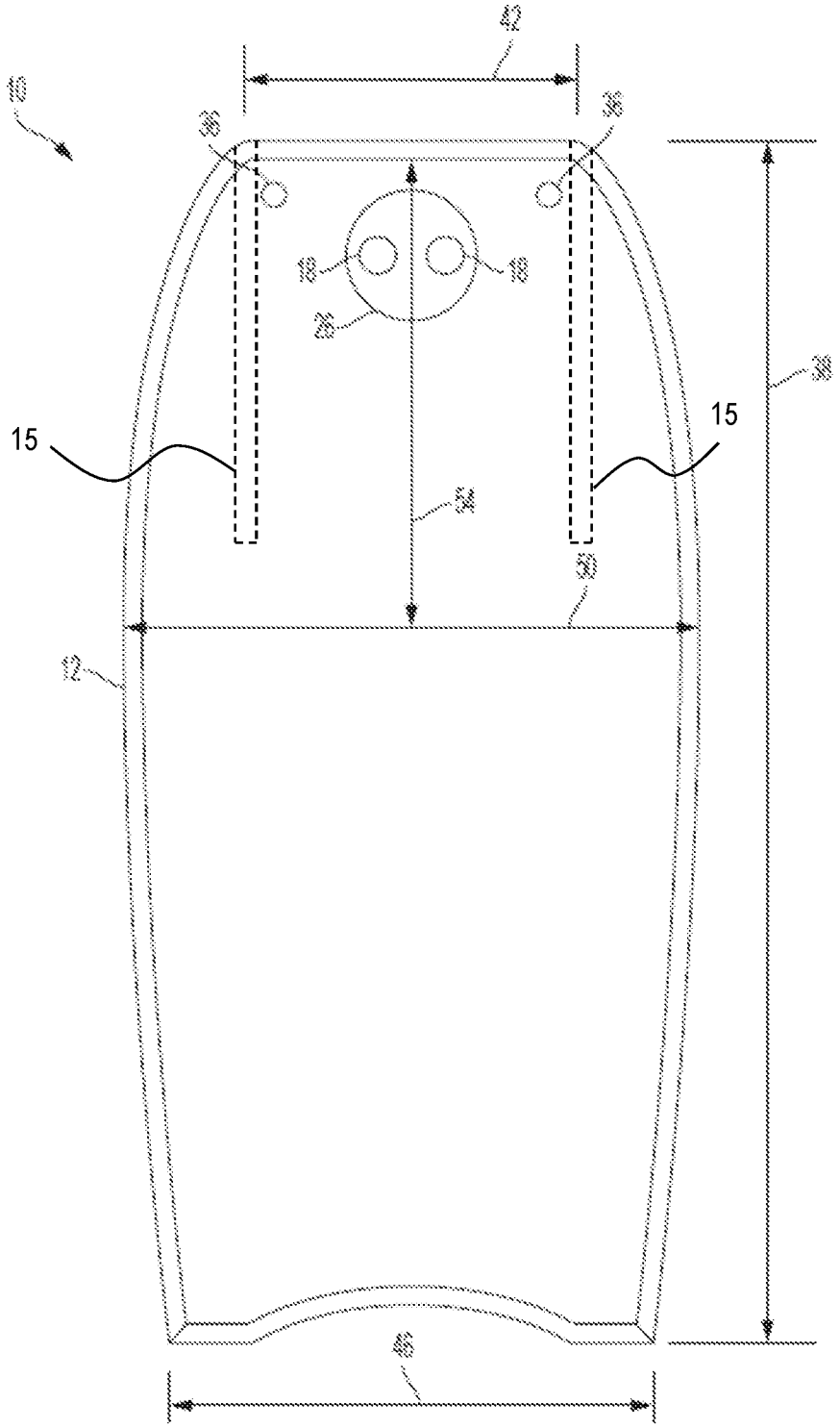
FIG. 3 is a plan view of the assembly of FIG. 1A in a water sports configuration.

The half plugs 26 of the illustrated arrangement include openings 32 in which the stops 18 are removably securable as shown in FIG. 3. FIG. 3 illustrates the assembly 10 in a water sports or bodyboard configuration wherein the half plugs 26 are both threaded into the aperture 14 and the stops 18 are removably secured, such as by threading, within the openings 32. To further secure half plugs 26 together when used in the water sports configuration, one or more of the stops 18 can be inserted into openings 32 through the half plugs 26 from top and bottom to allow the threaded ends of the stops 18 to meet and connect. By tightening the stops 18, the material of the board 12 compresses and secures the half plugs 26 together while sealing the aperture 14. In certain embodiments, the stops 18 have an external male threaded end and an internal female threaded receiver end. Both ends of the stops 18 are topped by caps that will be flush to the half plugs 26 when tightened. The cap tops may have an eye to allow a tether to be threaded through for securing a leash. When secured, the half plugs 26 and stops 18 will be flush to the surrounding body material so as not to impede the water-planning, or surfing effect.

The stringers 22 are inserted through respective lumens 15 within the board 12 to provide reinforcement and additional strength to the board 12. Though not illustrated, the stringers 22 may include threaded portions for engagement to threaded features in the lumens or threaded features in the anchors 30.

Stops 18 substantially longer than the thickness of the board 12 are not used in the water sports configuration. The stops 18 shown in FIG. 3 are therefore conventional leash plugs securable to the board 12 or combined half plugs 26 such that caps on either side of the leash plugs fit against the board 12 or half plugs 26 to provide a relatively smooth surface. One of the sides of stops 18 can have an attachment for a lanyard or leash to be grasped or releasably attached to a user of the bodyboard. If stops 18 including elongated bolts 19 are provided along with the assembly 10, they are not put through the holes 26 or apertures 32 in the water sports configuration.

The half plugs 26 and the stops 18 cooperate to form an enclosed space within the aperture 14 in the water sports configuration shown in FIG. 3. The enclosed space may be left empty or filled as desired to affect the overall density and/or weight of the assembly 10. In some cases, this space can hold components of the assembly that are not needed for the water sports configuration, such as screws or plugs. For example, if the enclosed space is left empty, it will contribute buoyancy to the assembly 10 by retaining a pocket of air within the aperture 14. In alternative arrangements, the half plugs 26 lack openings 32 and therefore create the enclosed space without cooperation from the stops 18.

In the illustrated arrangement, the board 12 has dimensions approximating those of a regulation sized cornhole board. A length 38 of the board 12 extends from a front end of the board 12 to a back end of the board 12. In one embodiment, the length 38 is 48 inches, And a width of the board 12 at its widest part 50 is 24 inches. A width of the front end of the board 12 is 14 inches, and a width of the tail end of the board is 20 inches. A distance from the front end of the board 12 to a center of the aperture 14 is 9 inches, a distance from either side end of the board 12 to the center of the aperture 14 is 12 inches, and the diameter of the aperture is 6 inches. In some embodiments, the aperture 14 is placed on the opposite end of the board so that it is 9 inches from the tail end instead. For boards 12 longer than 60 inches in length, the aperture 14 may be centered more than 9 inches from the nose or tail of the board 12. For boards less than 36 inches in length, the aperture 14 may have a lesser diameter and be centered less than 9 inches from the nose or tail of the board 12.

In one concrete embodiment, a board 12 can have a length of 54 inches, a maximum width of 20 inches, a width at the nose of 9 inches, a width at the tail of 18 inches, an aperture of a 6 inch diameter, with the center of the aperture centered widthwise and spaced 9 inches from the nose edge of the board. In another embodiment, a board 12 can have a length of 27 inches, a maximum width of 19 inches, a width at the nose of 9 inches, a width at the tail of 18 inches, an aperture of a 4 inch diameter, with the center of the aperture centered widthwise and spaced 8 inches from the nose edge of the board.

A perimeter of the board 12 from the perspective of FIG. 3 defines a contour on either lateral side that curves out to reach the greatest width 50 and narrows down to the width of the front end of the board 42 and the width of the back end of the board 46. The greatest width 50 is separated from the front end of the board 12 by a taper distance 54 of about 29 inches. Because the taper distance 54 is less than half of the length 38, the board 12 is relatively laterally wide in the area including and immediately behind the aperture 14. The illustrated shape therefore provides a useful amount of surface area in the portions of the board 12 where bean bags, typically 7 inches square when flat, land most frequently during a typical bag toss game while having an ergonomic and hydrodynamic profile suitable for water sports.

The dimensions described above coincide with the generally accepted rules of cornhole, although certainly other sizes of boards can be used. In some embodiments, the outer perimeter of the board fits within a 48 by 24 inch rectangle per the length and width dimensions indicated above. In other embodiments, the board may be larger so that a 48 by 24 inch rectangle can be placed on the flat upper surface of the board. Still in other embodiments, the relative length and width can be changed, and the location and size of the aperture 14 can be different as dictated by particular uses intended for the assembly 10 in a water sports configuration, the placement of the stringers 22, etc. The thickness of the board is equal to or about 2.5 inches at its thickest region near the center and tapers to a thickness of equal to or about 2 inches at its edges. The board's body thickness may vary to accommodate the user's weight, skill level and surf conditions. In general, it will be understood that the dimensions and proportions described here, and the size and shape of the board 12 varies in other arrangements to suit different water sports. The body size of the board 12 may vary but will be similar to existing water sport boards including, paddleboards, bodyboards, surfboards, stand-up paddleboards, etc. The user will choose a properly sized board based upon their height, weight, skill level and conditions.

Figure 4A:
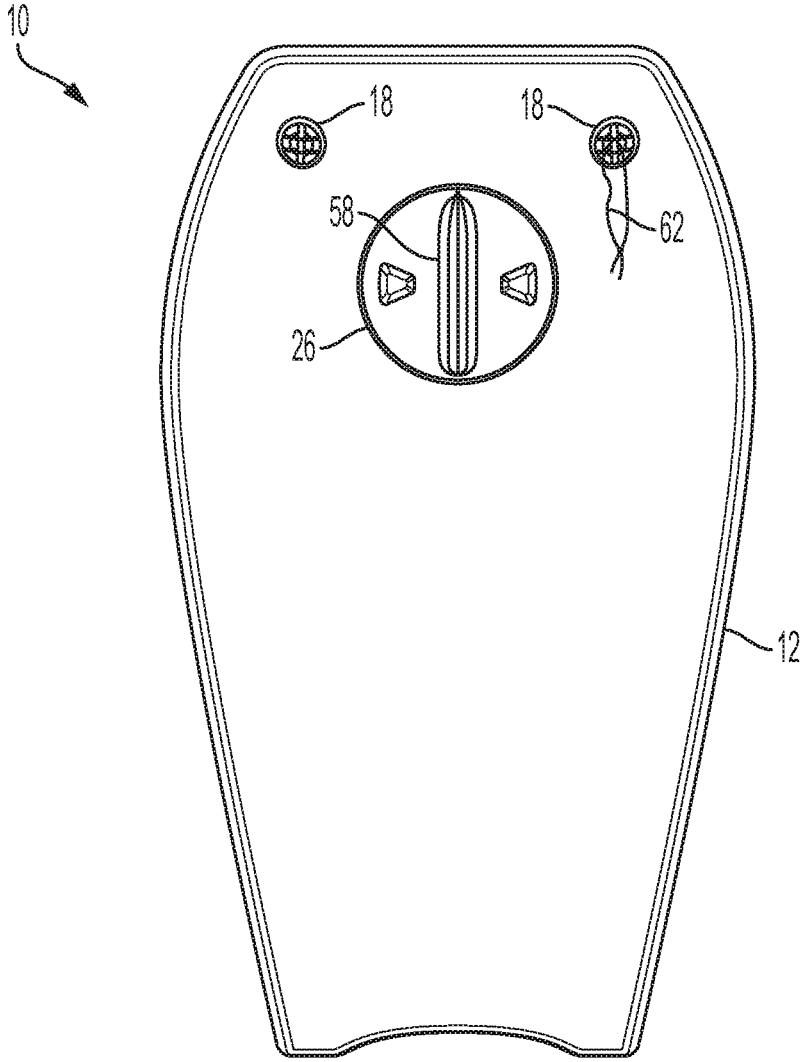
FIGS. 4A and 4B show a connection of an optional component of the assembly of FIG. 1A.
Figure 4B:
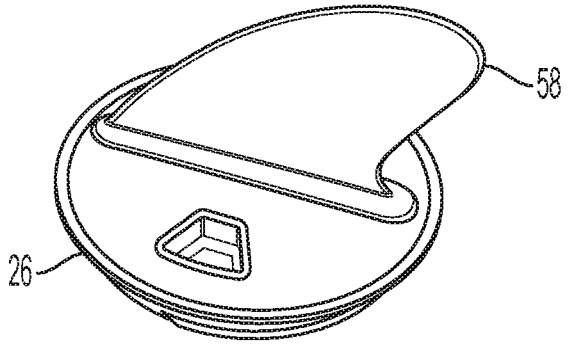

FIGS. 4A and 4B depict a fin 58, which is an accessory that may optionally be included in the assembly 10. In the illustrated example, the fin 58 connects to one of the half plugs 26 with protrusions that pop into the openings 32. FIG. 4A in particular shows the assembly 10 in an alternate water sports configuration wherein the fin 58 is connected to one of the half plugs 26 to extend out from the board 12, and the stops 18 are each disposed in one of the holes 36 for the stops 18. A tether 62 is also connected to a loop formed in one of the stops 62.

As shown in FIGS. 1A-4B and the above description, the assembly 10 is capable of serving as both an implement for a yard game and a water sports board. To that end, the assembly 10 may be provided in a kit that further includes items associated with yard games or water sports, such as bean bags, balls, discs, frisbees, and/or other thrown items, and/or additional attachments like the fin 58 and tether 62. In some instances, the stringers 22 can be anchored directly into the ground surface rather than being anchored into the half plugs 26, particularly if the surface, such as gravel, wet sand, etc., is strong enough to hold the stringers 22 in place without allowing them to press into the surface and lower the pitch of the board 12. This can also be done when the anchor points of the stringers 22 to the board 12, i.e. at stops 18, are very strong. In still other embodiments, half plugs 26 can be made out of or lined or coated with a material that is buoyant in water, such as foam. Other embodiments allow for an inflatable ring or disc to be placed around or under the half plugs 26 to allow them to float on water. In this way, when the assembly 10 is in its yard play configuration, it can actually be used on the surface of a body of water since both the board 12 and the half plugs 26 can float. The board 12 can also be marked or etched with targets or designated areas to allow for different types or variations of games to be played. In other embodiments, the game can be played without the board 12 angled at all, but rather, lying flat on a ground or water surface. An alternate configuration of the plug can be a single monolithic plug spanning the thickness of the board 12 that is inserted from either the top or the bottom of the board 12. This may be usable in instances where the half plugs 26 are not required to anchor the stringers in gameplay mode.

Conversion of the assembly 10 from the water sports configuration shown in FIGS. 3 and 4A to the yard game configuration shown in FIG. 1A includes removal of the half plugs 26 from the aperture 14 and removal of the stringers 22 from the lumens within the board 12. In the method, stops 18 are secured in openings 32, and one end of the board 12 is propped on the stringers 22, which are connected to the stops 18. In this way, the board 12 is lifted away from a supporting surface. That is, the stringers 22 are completely separated from the board 12 and reattached at the stops 18, in some embodiments in two or more different angles with respect to the upper surface of the board 12 so that the stringers 22 are effectively adjustable with respect to the board 12. In the arrangement shown in FIG. 1A, a lengthwise end of the board 12 that is closer to the aperture 14, or a front end of the board 12, is propped on the stringers 22. In the yard play configuration, the stringers 22 can be used to prop the board 12 up so that the front end is 13.5 inches from the ground. The tail end of the board can be propped up on other components, either part of the assembly 10 or else rocks, bricks, sand, etc., so that it is 4 inches from the ground. The half plugs 26 are both placed on the supporting surface, and one end of each of the stringers 22 is placed in a respective one of the anchors 30 of the half plugs 26. If the fin 58 was installed on either of the half plugs 26, it is removed from the half plug 26 before the half plugs 26 are both placed on the supporting surface.

To return the assembly 10 from the yard game configuration to the water sports configuration, the above described steps may be performed in reverse order. That is, the stringers 22 are removed from the stops 18 and reinserted into the lumens of the board 12. The half plugs 26 are screwed into the aperture 14 to effectively seal the aperture 14 from being inundated with water. Stops 18 can either be converted to anchors for leash plugs or removed entirely from the board 12.

Figure 5:
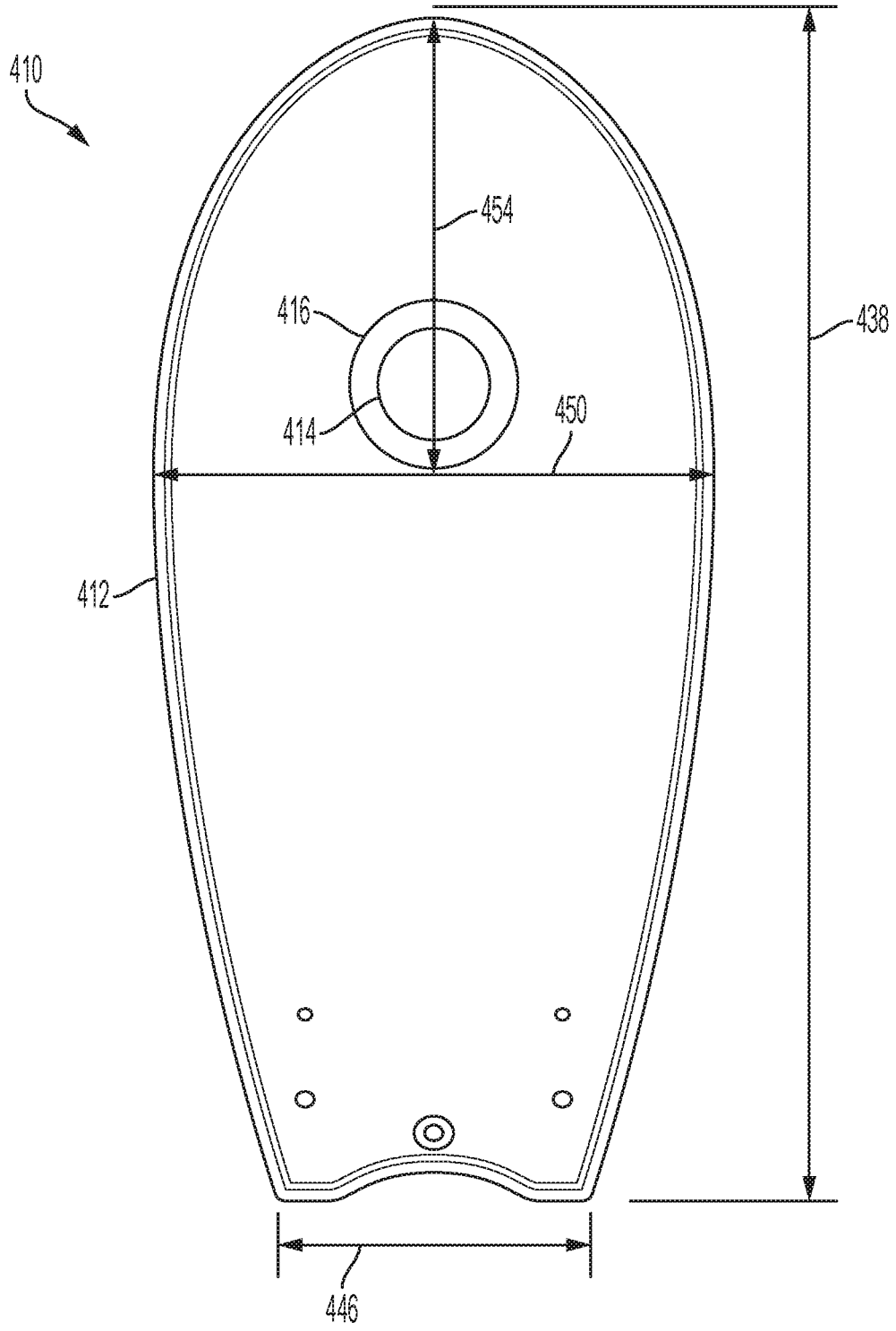
FIGS. 5-7 illustrate a board of a assemblies according to various alternative arrangements.

An assembly 410 according to an alternative arrangement is illustrated in FIG. 5. The assembly 410 is generally similar to the assembly 10 of FIG. 1A, except for differing dimensions and a structurally distinct collar 416 around the aperture 414. While a board 412 may be made entirely or mostly of materials usable for a floatation device, including EVA or another closed cell copolymer, the collar 416 is made of a relatively rigid plastic or metal. In the illustrated example, the collar 416 includes internal threading for receiving a plug, or the half plugs 26. The relative material strength of the collar 416 enables the collar 416 to threadingly hold a plug, such as that provided by the half plugs 26, in resistance to forces such as those resulting from water pressure during use of the assembly 410 in a water sports configuration.

As made evident by the above description, assembly 10 presents a novelty over the prior art by including a sealable aperture in the flotation type board 12. The aperture is a functional element of the board in the yard play configuration of assembly 10, while also being substantially sealable in the water play configuration. This allows assembly 10 to function as a water device such as a bodyboard, including the use of stringers and leash plugs or lanyards. At the same time, the removable plug allows for a quick and easy conversion from the water sports configuration to the yard play configuration so that the assembly 10 can double as a cornhole board, for use either on land or in water. Prior art aquatic boards have never been designed for such a dual purpose. Moreover, the use of a closed cell polymer material allows assembly 10 to maintain its integrity as a bodyboard or water sports board since the material will resist bloating or becoming waterlogged despite the presence of aperture 14, which includes an open inner circumference exposing an inner portion of the closed cell polymer material. The plug substantially encloses and seals the aperture. The interface between the plug and the wall of the aperture, which is unlikely to be entirely and completely void of water, presents no disadvantage in using assembly 10 in both the water and gameplay modes.

Figure 6:
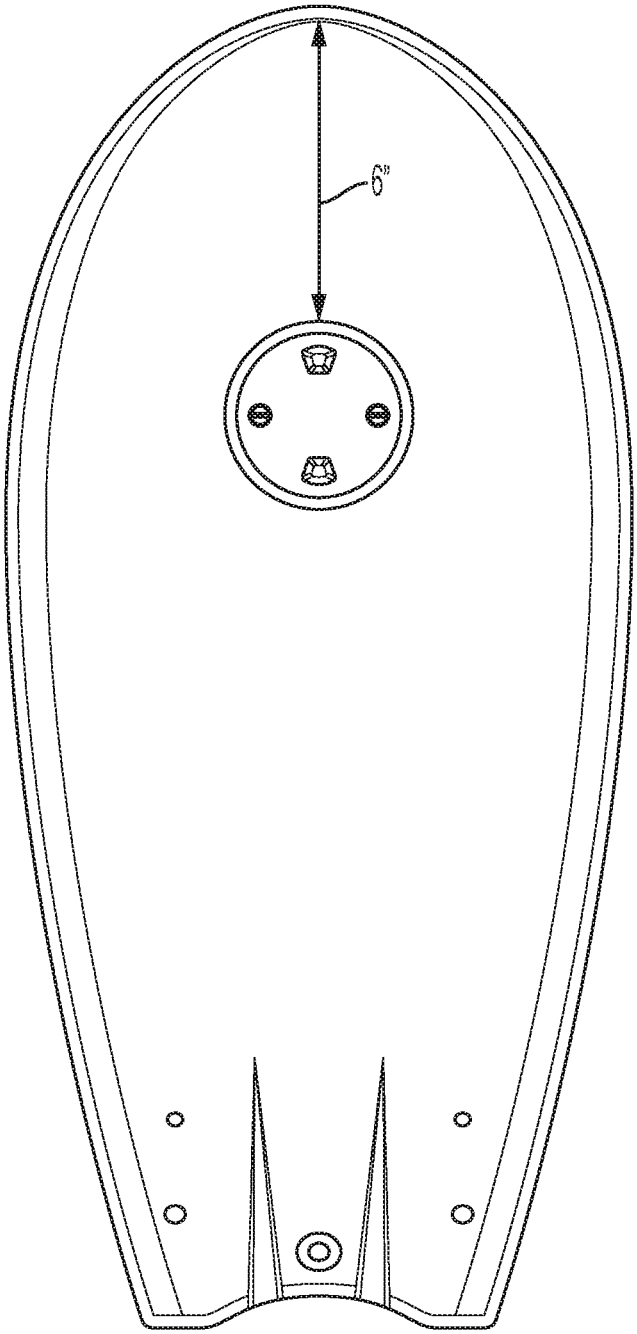
Figure 7:
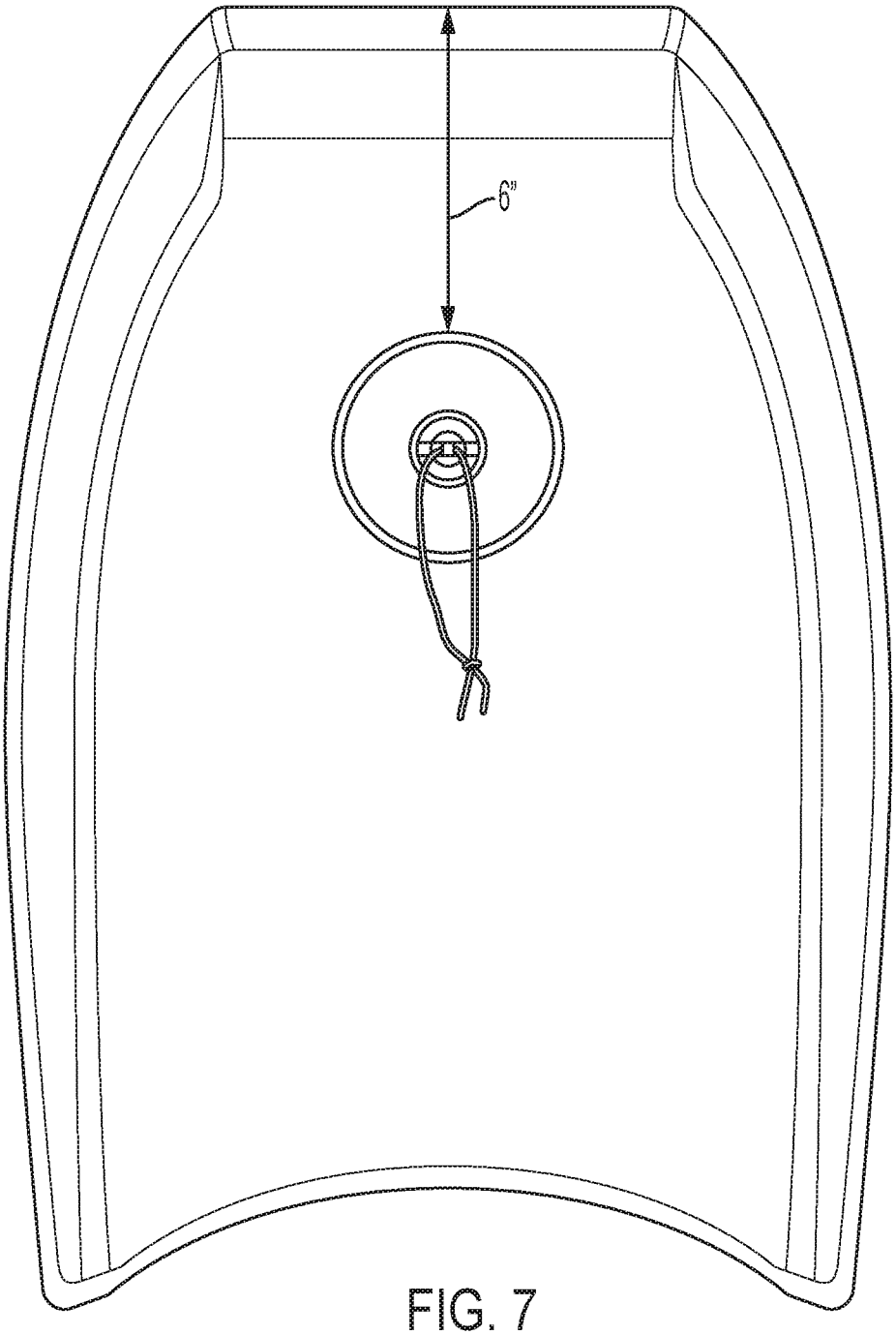

FIGS. 6 and 7 illustrate assemblies according to alternative arrangements. The assemblies of FIGS. 6 and 7 are functionally different from those above, and differ primarily in dimensions and proportion. The elements in FIGS. 6 and 7 are therefore not enumerated, as their function should be evident from the foregoing description of corresponding features in other arrangements. FIGS. 6 and 7 are presented in the true proportions of the arrangements they represent.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A recreational assembly comprising:

a body having an upper surface, a lower surface, and a thickness defined between the upper and lower surfaces, the upper surface having a width and a length, wherein the thickness is less than the width, the body defining an aperture extending through the thickness of the body from the upper surface to the lower surface, and two lumens extending within the body;

two or more stringers removably insertable into the lumens, respectively, and each having a first end and a second end; and a plug removably insertable into the aperture of the body, the plug including upper and lower plates configured to be secured within the aperture, wherein each of the upper and lower plates includes an anchor on one side, wherein in a water sports configuration, the plug is disposed in the aperture, and wherein in a game configuration, two of the stringers are configured such that the first ends thereof are connected to the body and the second ends thereof are connected with the anchors, respectively, of the upper and lower plates.

2. The assembly of claim 1, wherein the body is constructed of a closed cell copolymer.

3. The assembly of claim 1, wherein when the plug is inserted into the aperture of the body, the plug substantially fills the aperture.

4. The assembly of claim 1, wherein the body further defines two body holes extending through the thickness of the body.

5. The assembly of claim 4, wherein one of the upper and lower plates defines two plate holes extending therethrough.

6. The assembly of claim 5, further comprising two stops insertable into the respective body holes and the respective plate holes.

7. The assembly of claim 6, wherein the stops are externally threaded.

8. The assembly of claim 6, including a tether attachable to one of the stops.

9. The assembly of claim 1, further comprising a fin attachable to one of the plates.

10. The assembly of claim 1, wherein each of the plates includes an externally threaded ring and a cap at an end of the ring, the cap having a greater area than a circular cross-section of the ring.

11. The assembly of claim 10, wherein when the plug is inserted into the aperture of the body, the cap of each of the plates is substantially flush with one of the upper and lower surfaces of the body.

12. The assembly of claim 10, wherein the anchor is a socket is disposed on a side of the cap facing into the ring.

13. The assembly of claim 1, wherein the lumens extend along the length of the body.

14. The assembly of claim 1, wherein the upper surface of the body is substantially flat.

15. The assembly of claim 1, wherein the width of the upper surface is no greater than 24 inches, the length of the upper surface is no greater than 48 inches, and the aperture is circular with a diameter of 6 inches.

16. A recreational kit comprising:

the recreational assembly of claim 1; and a bean bag or a ball sized to pass through the aperture.

17. The assembly of claim 1, wherein in the water sports configuration, at least two of the stringers are disposed within the lumens.

18. The assembly of claim 1, wherein in the game configuration, the first ends of the two of the stringers connected to the body are disposed in two body holes, respectively, defined by the body, with the upper and lower plates and an end of the body configured to be disposed on an external surface.

19. The assembly of claim 18, wherein the external surface is the ground.

20. The assembly of claim 1, wherein the anchor of at least one of the upper and lower plates includes a partially spherical socket and at least one of the stringers includes a ball at the second end thereof to allow pivoting movement between the ball and the socket in the game configuration.

21. A recreational assembly comprising:

a body formed of a closed cell copolymer and having an upper surface, a lower surface, and a thickness defined between the upper and lower surfaces, the upper surface having a width and a length greater than the width, wherein the thickness is less than the width, the body defining an aperture extending through the thickness of the body from the upper surface to the lower surface, two lumens extending within the body along a length of the body, and two holes extending through the thickness of the body;

two or more stringers removably insertable into the lumens, respectively, and each having a first end and a second end;

two stops removably securable through the two holes in the body; and a plug removably insertable into the aperture of the body, the plug including upper and lower plates configured to be secured within the aperture, wherein each of the upper and lower plates includes an anchor on one side, wherein in a water sports configuration, the plug is disposed in the aperture, and wherein in a game configuration, two of the stringers are configured such that the first ends thereof are connected to the body and the second ends thereof are connected with the anchors, respectively, of the upper and lower plates.

* * * * *